US006015959A

United States Patent [19]

Slepian et al.

[11] Patent Number: 6,015,959

[45] Date of Patent: Jan. 18, 2000

[54] MOLDED CASE ELECTRIC POWER SWITCHES WITH CAM DRIVEN, SPRING POWERED OPEN AND CLOSE MECHANISM

[75] Inventors: Robert Michael Slepian, Murrysville, Pa.; William Christopher Farrow, Germantown; Michael Thomas Little, Cedarburg, both of Wis.; H. Richard Beck, Corapolis, Pa.; William George Eberts, Moontownship, Pa.; David Curtis Turner, Imperial, Pa.

[73] Assignee: Eaton Corporation, Cleveland, Ohio

[21] Appl. No.: 09/183,464

[22] Filed: Oct. 30, 1998

[51] Int. Cl.[7] ..... H01H 5/00

[52] U.S. Cl. ..... 200/400; 200/401; 200/424

[58] Field of Search ..... 200/400, 401, 200/424

[56] References Cited

U.S. PATENT DOCUMENTS

| | | | |
|---|---|---|---|
| 3,134,879 | 5/1964 | Gauthier et al. | 200/169 |
| 4,114,005 | 9/1978 | Maier et al. | 200/153 |
| 4,264,796 | 4/1981 | Nelson et al. | 200/153 |
| 5,057,806 | 10/1991 | McKee et al. | 335/9 |
| 5,280,258 | 1/1994 | Opperthauser | 335/162 |

*Primary Examiner*—Michael L. Gellner
*Assistant Examiner*—Nhung Nguyen
*Attorney, Agent, or Firm*—Martin J. Moran

[57] ABSTRACT

Molded case electric power switches such as circuit breakers, disconnects and transfer switches have an energy storage spring which rotates a cam assembly to close and initiate opening of the switch contacts. The cam assembly includes a drive cam with a cam lobe which engages a drive cam follower on the moving contact assembly. Due to space limitations, the cam assembly is positioned so that the drive cam follower initially moves toward the cam assembly during closing. To accommodate for this, the cam lobe has a generally radial leading edge to prevent binding of the drive cam follower. A single latch mechanism latches the cam assembly in a spring charged position and in a closed position. A Y-shaped latch member has one leg which is engaged by a latch, a second leg which engages stops on the drive cam at the charged position and the closed position, and a third leg which sequentially engages the stops to reset the latch mechanism. The cam assembly, a charging mechanism including a rachet wheel and handle, the latch mechanism and the energy storage spring are all mounted between and supported by a pair of side plates. In a multi-pole switch, the drive cam engages the moving contact assembly of one pole which is coupled to the moving contact assemblies of the other poles by a cross-bar.

15 Claims, 8 Drawing Sheets

MOLDED CASE ELECTRIC POWER SWITCHES WITH CAM DRIVEN, SPRING POWERED OPEN AND CLOSE MECHANISM

BACKGROUND OF THE INVENTION

1. Field of the Invention

This invention relates to switches used in electric power distribution systems such as circuit breakers, disconnects and transfer switches. More particularly, it relates to the operating mechanism for opening and closing the contacts of molded case power switches, and specifically an operating mechanism which uses energy stored in a spring and delivered through a cam assembly to close and open the switch contacts.

2. Background Information

Switches used in electric power distribution systems are well known. Such switches include circuit breakers which provide overcurrent and short circuit protection. Similar switches without such protection are used as disconnects to isolate a particular load or section of the distribution system and as transfer switches to switch between sources such as a utility and an emergency power generator.

Different types of switching mechanisms are used for such power switches in different parts of the power distribution system depending in part upon the current to be handled by the particular switch. The various switches are designed to handle up to a specified "rated" current. One of the factors related to the rated current is the amount of force needed to close the switch and hold it closed against the magnetic repulsion force generated by the current.

Molded case switches, so named because the mechanism is mounted in a molded, electrically insulative resin housing, typically have a rated current of from 3 to 2,500 amperes. Conventionally, such molded case switches have a spring powered toggle mechanism which opens the contacts. The opening spring is charged by closing of the switch. This is performed manually by a handle or can be effected remotely with a motor operator.

Larger power switches which are required to withstand the larger magnetic repulsion forces generated at the higher current ratings, require larger forces to close the contacts. Typically, such higher closing forces cannot be generated by a direct acting manual handle. Thus, the larger power switches have a closing spring which releases stored energy to close the contacts. This closing spring may be charged manually, usually by a handle acting through a rachet mechanism, or electrically by a motor operator. Typically, these power switches have a closing cam driven by the closing spring which rotates a pole shaft to in turn close the contacts. Separate latches are used to close and open the contacts.

Improvements in molded case switches for electric power distribution systems have resulted in switches with higher current ratings. However, the closing forces required for these molded case switches with higher current ratings cannot be conveniently generated by the direct acting handle or the conventional motor operators designed for such switches. Furthermore, the conventional spring driven closing mechanisms of the larger circuit breakers, with their pole shaft and other components are too large for adaptation to molded case switches with higher rated currents.

Therefore, there is a need for improved molded case switches for electric power distribution systems with extended current ratings.

More particularly, there is a need for such improved molded case switches which incorporate a closing spring.

There is an additional need for a mechanism with a closing spring which can be accommodated in the conventional molded casing.

There is a further need for such a molded case switch which incorporates a close spring but which does not require complete redesign of the entire switch.

SUMMARY OF THE INVENTION

These needs are others are satisfied by the invention which is directed to a molded case electric power switch which can be accommodated in the already available molded casing yet incorporates a close spring. The novel operating mechanism of this improved molded case switch utilizes a drive cam to directly engage the existing moving contact assembly.

More particularly, the invention is directed to a molded case electric power switch which includes an operating mechanism incorporating a cam assembly including a cam shaft, a drive cam, an energy storage spring and means coupling the energy storage spring to rotate the drive cam. Because of the limited space available in the molded casing, the drive cam has a cam lobe configured to engage the moving contact assembly to close the contacts, and yet disengage from the moving contact assembly as the drive cam is rotated to an open position. With the drive cam clear of the moving contact assembly, an opening spring biases the moving contact assembly to open the contacts. The moving contact assembly includes a cam follower which, because of the positioning of the components dictated by the limited space available, moves closer to the cam shaft as it is engaged by the cam lobe. In order to prevent binding, the cam lobe has a leading edge configured to allow this movement by the cam follower toward the cam shaft initially during closing. Preferably, the leading edge of the drive cam lobe is configured to be generally radial to the cam shaft. The drive cam lobe has a trailing edge which forms a notch accommodating release of the drive cam follower from the moving contact as the drive cam is rotated to the open position.

The energy storage spring rotates the drive cam to close the main contacts of the switch and then rotates the drive cam further to an open position to allow the contacts to be opened by the opening spring. The energy storage spring is charged by a spring cam mounted on the cam shaft and coupled to the energy storage spring through a coupling link. This spring cam has a charging profile which stores energy in the spring as the cam shaft is rotated by a spring charging mechanism, and an energy release portion over which the spring releases energy to rotate the spring cam and with it the drive cam. The operating mechanism also includes a latch mechanism latching the cam assembly in a charged position with the spring fully charged, and also latching the cam assembly with the drive cam in the closed position in which the separable contacts are closed.

A single latch member is employed to latch the cam assembly in both the charged position and the closed position. The latch mechanism includes a latch which is actuated a first time to close the separable contacts and a second time to open the contacts. The latch mechanism also includes a Y-shaped latch member having a first leg which is engaged by the latch, and a second leg which engages a first stop on the cam assembly to retain the cam assembly in the charged position until the latch is released the first time. This second leg also engages a second stop on the cam assembly to retain the cam assembly in the closed position until the latch is released the second time. The latch member further includes a third leg which is engaged by the cam assembly to relatch the latch member following release of the latch the first and second times. This third leg of the latch member is actuated by the first stop to reset the latch during closing of the contacts, and is engaged by the second stop to again reset the latch during opening of the contacts.

The spring charging mechanism includes a rachet wheel on the cam shaft, and a handle mechanism which incrementally rotates the rachet wheel.

The operating mechanism of the invention is a very compact but powerful mechanism with a closing spring. All of the major components including the cam assembly, the energy storage spring and its coupling to the cam assembly, the rachet wheel, and if provided, the handle mechanism, as well as the latch mechanism, are mounted between and supported by a pair of side plates supported in the molded casing.

For multi-pole circuit breakers a single operating mechanism operates the moving contact assembly of one pole, typically the center pole, with the other poles being simultaneously operated by a cross-bar.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention will be described as applied to a molded case circuit breaker; however, it will be apparent that the invention has application to other molded case electric power switches for electric power distribution systems.

Figure 1:
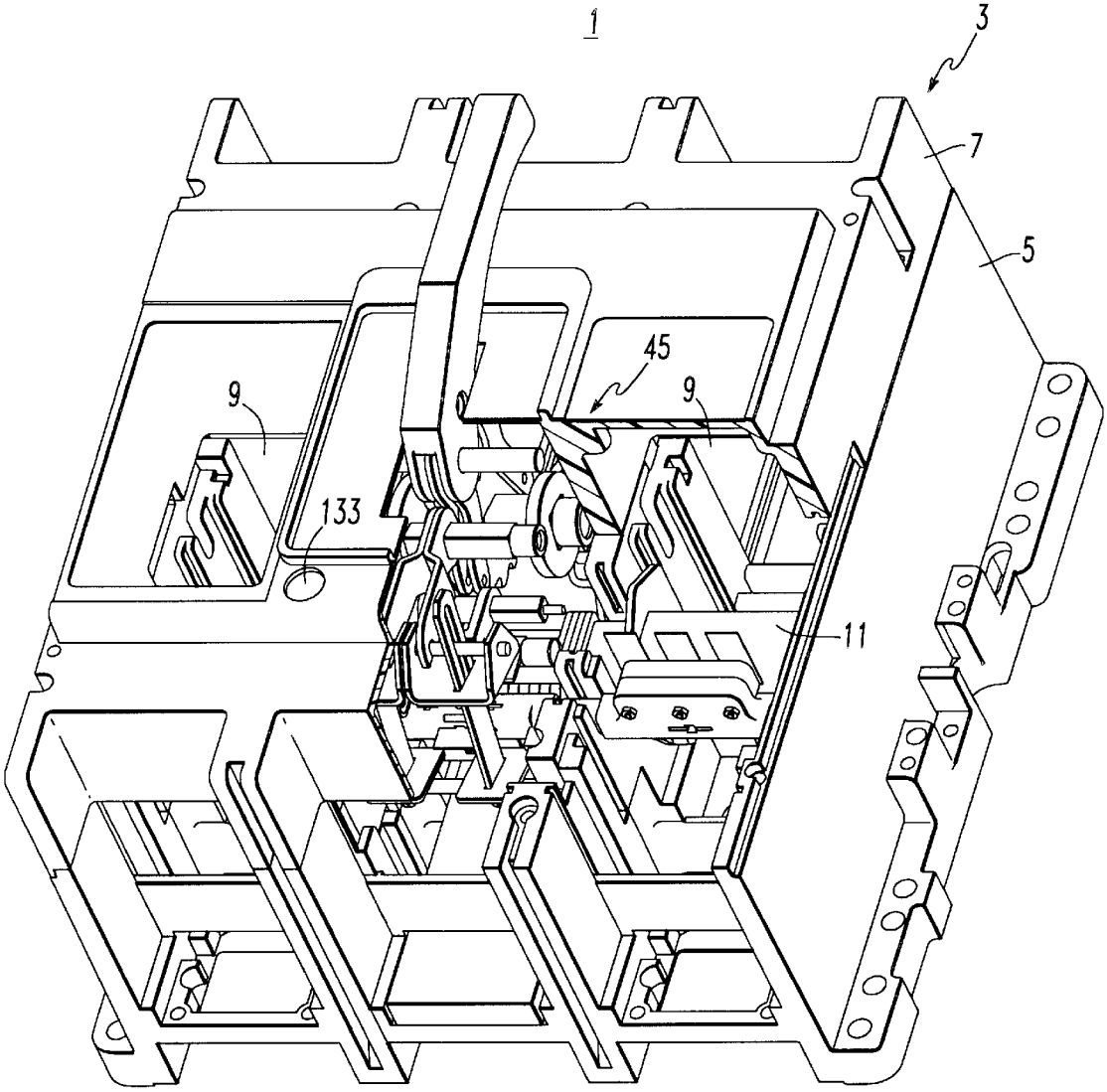
FIG. 1 is an isometric view with some parts removed and other parts cut away of a circuit breaker incorporating the invention.

Referring to FIG. 1, the molded case circuit breaker (mccb) 1 forming the electric power switch of the invention includes a molded casing 3 made of an electrically insulative resin, such as, for instance, a glass-filled polyester, having a base section 5 and a cover 7. The base 5 is divided into compartments 9 each housing a pole 11 of the circuit breaker. Exemplary circuit breaker 1 is a 3-pole breaker, but the invention can also be applied to circuit breakers with other numbers of poles.

As shown in FIGS. 3A–3D, each pole includes a set of separable contacts 13 including a stationary main contact 15, a moving main contact 17, and stationary and moving arcing contacts 19 and 21. These poles 11 can be of the type shown in the circuit breaker described in U.S. Pat. No. 5,057,806 which is hereby incorporated by reference. The stationary main contact 15 and the stationary arcing contact 19 are both mounted on a line side conductor 23. The moving main contact 17 and moving arcing contact 21 are supported by moving contact assembly 25. This moving contact assembly 25 includes a contact arm 27 to which the moving contacts 17 and 21 are fixed adjacent a free end 29. A second end 31 of the contact arm 27 is mounted for pivotal rotation by a contact arm carrier 35 which, in turn, is pivotally mounted by a fixed pivot pin 37 supported by a bracket 39.

Figure 3A:
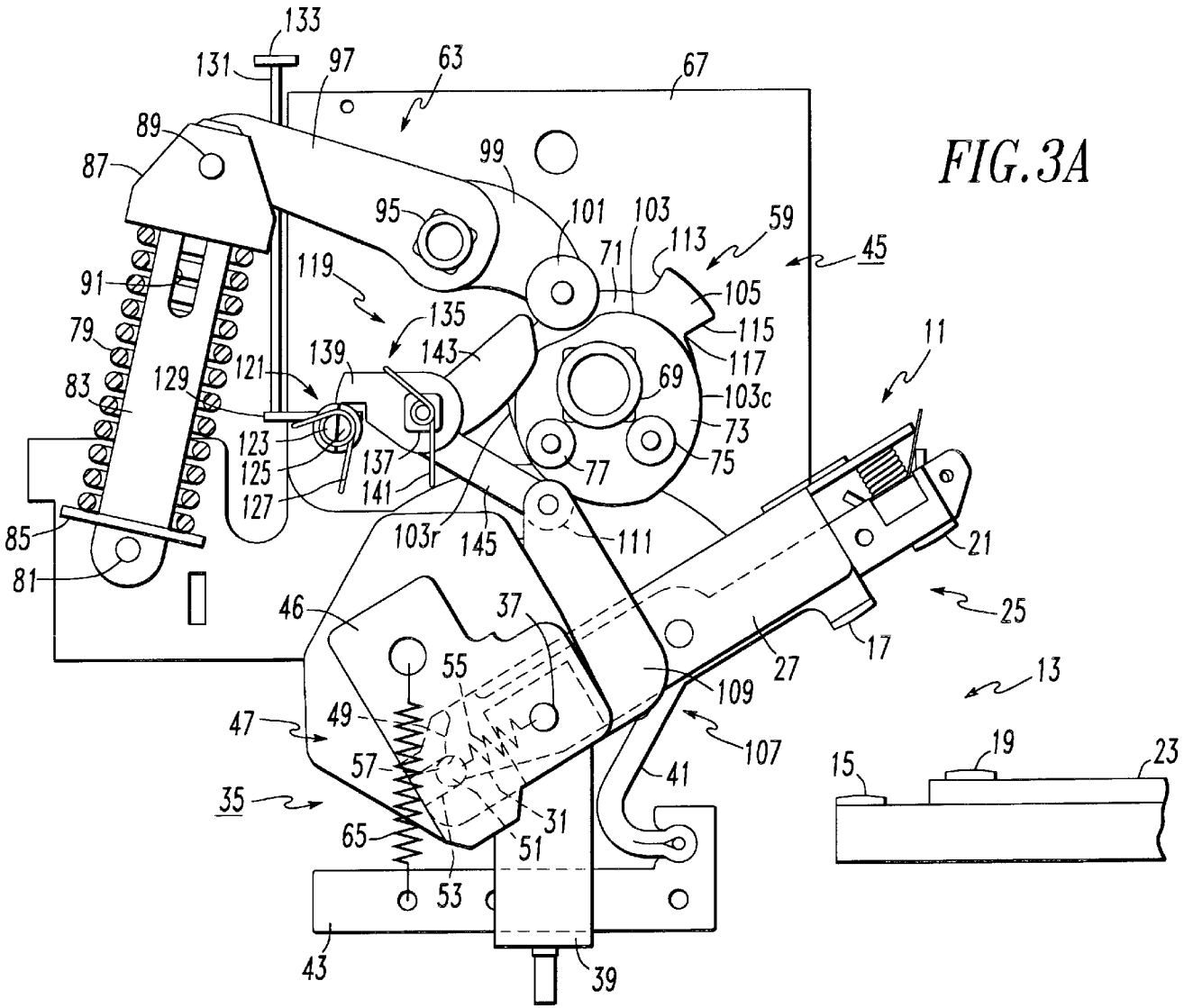
FIG. 3A is an elevation view through the operating mechanism of FIG. 2 taken along the line 3—3 with the contacts open and the spring uncharged.
Figure 3B:
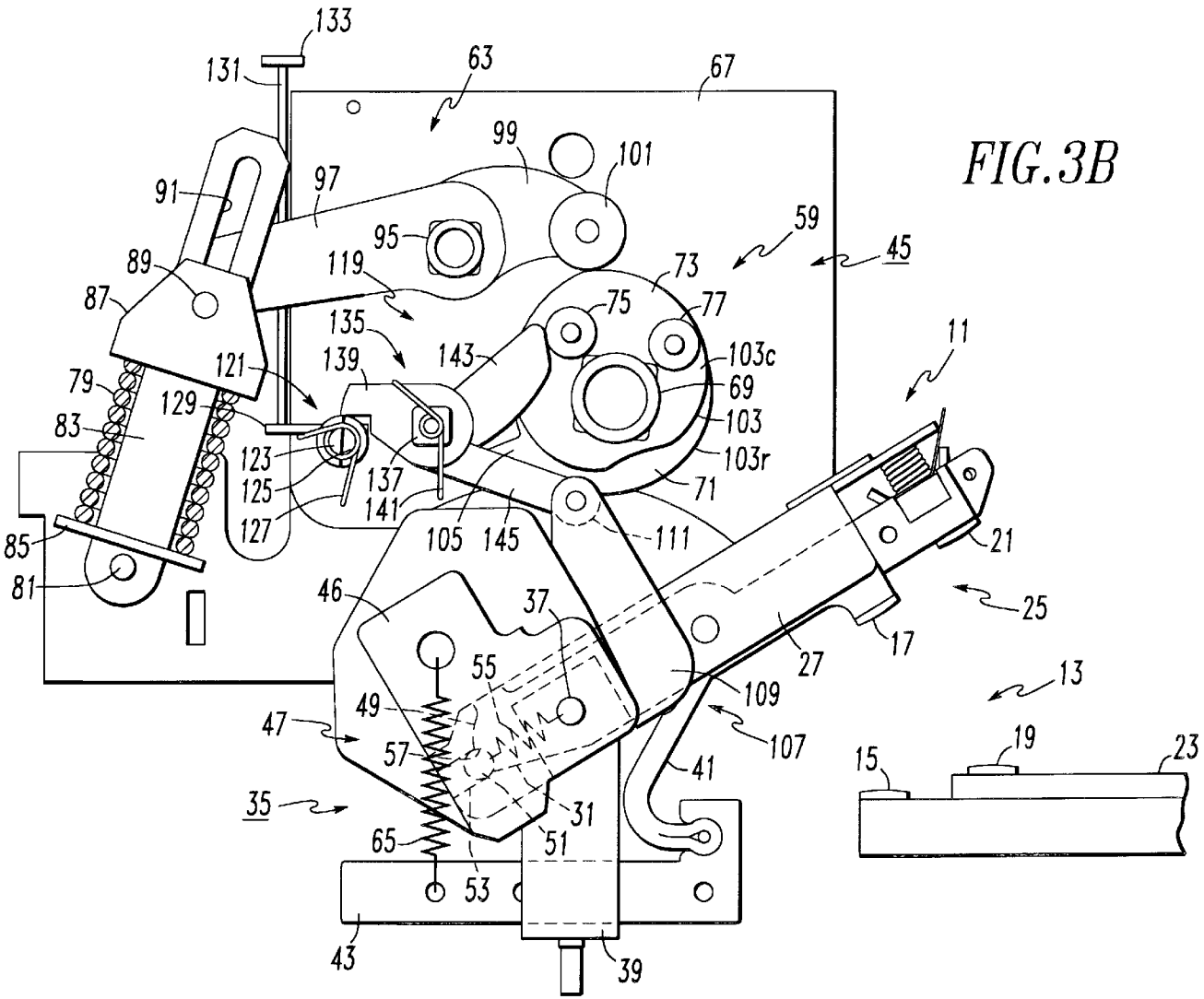
FIG. 3B is a view similar to that of FIG. 3A but with the contacts open and the spring charged.
Figure 3C:
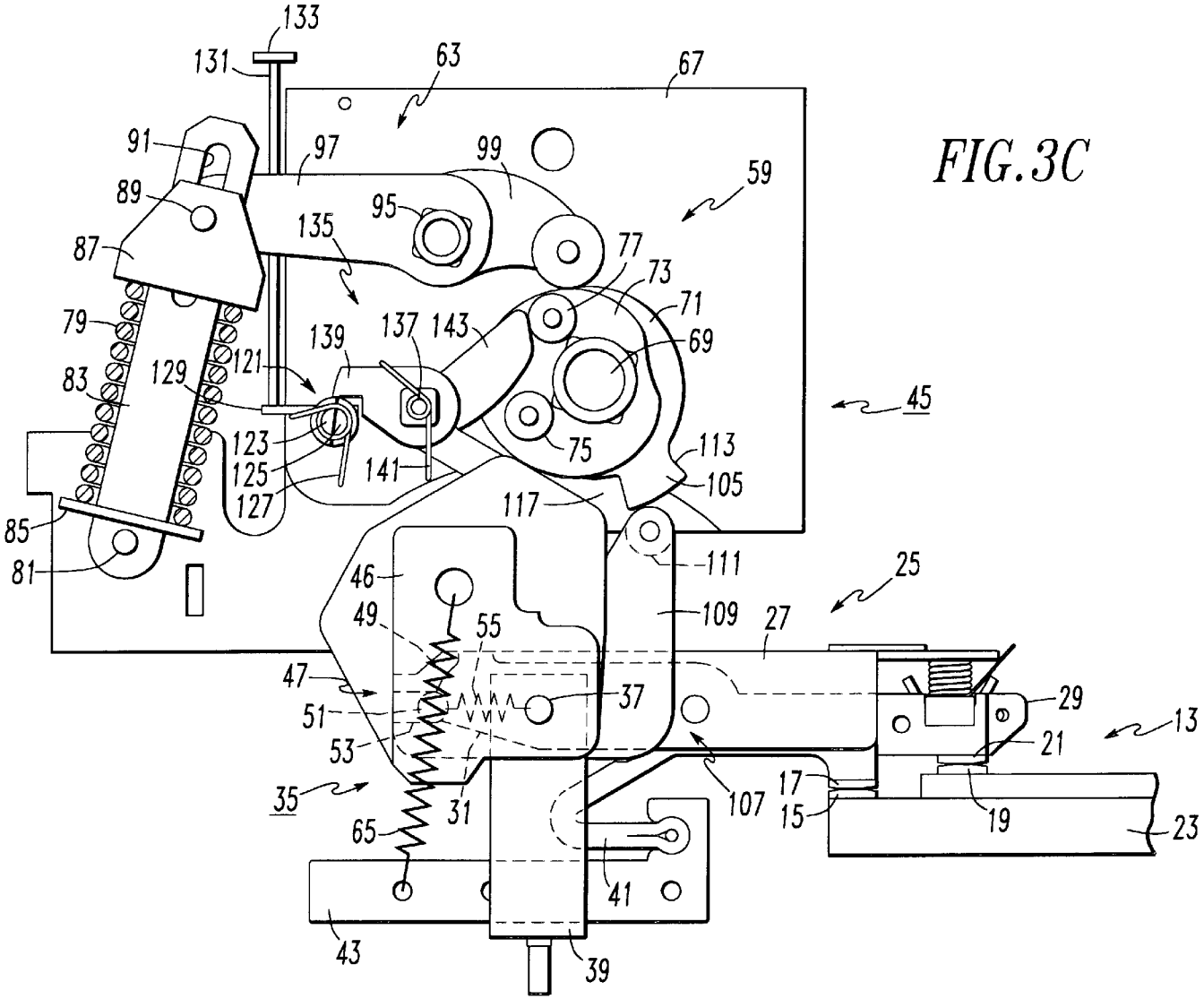
FIG. 3C is a view similar to FIG. 3A shown with the contacts closed and the spring partially charged.

The contact arm 27 can be rotated between the closed position shown in FIG. 3C and the open position shown in FIG. 3A in a manner to be described to open and close the separable contacts 13. The contact arm 27 is connected by flexible shunts 41 to a load side conductor 43, so that with the separable contacts closed, an electrical path is established between the line conductor 23 and a load conductor 43 through the separable contacts 13, the contact arm 27, and the flexible shunts 41.

Normally, the contact arm 27 is moved between the opened and closed positions by an operating mechanism 45 to be described. However, as is common, the separable contacts 13 can be blown open before the operating mechanism 45 operates in response to very high overcurrents such as caused by a short circuit. Such high currents generate magnetic repulsion forces which tend to rotate the contact arm towards the open position. The contact arm 27 is also mounted on the pivot pin 37 and is coupled to the contact arm carrier 35 by blow open coupling 47 which includes a camming surface 49 on the second end 31 of the contact arm 27 which engages a pin 51 biased in slots 53 in the carrier 35 against the camming surface 49 by springs 55. A notch 57 in the camming surface 49 normally couples the contact arm 27 to the contact carrier for movement therewith. However, the magnetic repulsion force generated by a short circuit is sufficient to rotate the arm 27 while the contact arm carrier 35 remains stationary by forcing the pin 51 to disengage from the notch 57 allowing the contact arm to rotate to the position shown in FIG. 3D.

As mentioned, normally the contact arm 27 is rotated between the opened and closed positions by the operating mechanism 45. The operating mechanism 45 engages the moving contact assembly 25 of the center pole 11 of the circuit breaker. As is well known, the contact arm carrier 35 for all of the poles 11 are interconnected, and therefore are rotated together, by a cross-bar 46.

Figure 2:
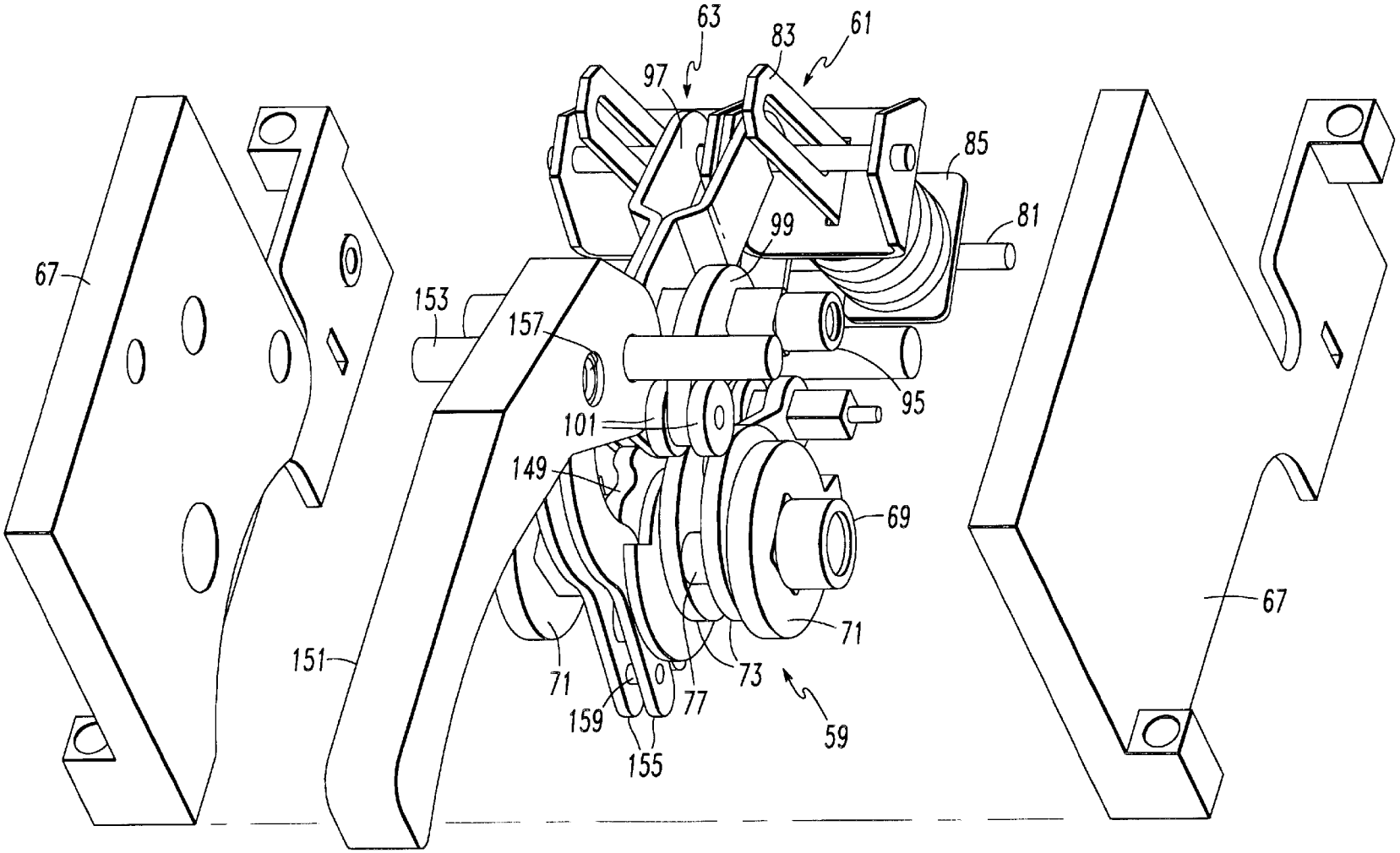
FIG. 2 is a partially exploded isometric view of an operating mechanism which forms part of the circuit breaker of FIG. 1.

Referring to FIG. 2, as well as FIGS. 3A–3D, the operating mechanism 45 includes a cam assembly 59, energy storage spring assembly 61, a coupling 63 which couples the energy storage springs to the cam assembly, and an opening spring 65. The operating mechanism 45 also includes a pair of side plates 67 supported in the base 5 in spaced relation on either side of the center one of the poles 11.

The cam assembly 59 includes a cam shaft 69 journalled in the side plates 67. Mounted at opposite ends of the cam shaft 69 are a pair of drive cams 71. Also mounted on the cam shaft 69 are a pair of spring cams 73 separated by a pair of stops 75 and 77. Except for cylindrical ends which are journalled in the side plates 67, the cam shaft 69 has a square cross section which engages square apertures in the drive cams 71 and spring cams 73 so that the cams are angularly fixed relative to each other and rotate as a unit.

The energy storage spring assembly 61 includes a pair of helical compression springs 79. The springs 79 are mounted between the side plates 67 by a common mounting pin 81 journalled in the side plates. For each spring 79, an elongated spring guide 83 is pivotally mounted at one end on the common mounting pin 81. A support plate 85 fixed to the guide adjacent the mounting pin supports the lower end of the spring 79. A clevis 87 bears against the upper end of the spring and is pivotally connected to the associated spring guide 83 by a common clevis pin 89 which extends through elongated slots 91 in the spring guides. For lower current ratings, a single energy storage spring 79 can be sufficient.

The energy storage spring or springs 79 are coupled to the cam assembly 59 by the coupling 63 in the form of a follower link. The follower link 63 includes a follower shaft 95 journalled in the side plates 67 and having a square shaft. A bifurcated link 97 engages the square shaft and the common clevis pin 89 within the two devises 87. The follower link 63 also includes a rocker arm 99 mounted on the square follower shaft 93 and having a pair of rollers 101 at the free end.

The spring cams 73 of the cam assembly 59 have a cam profile 103 on their peripheral surface against which the rollers 101 bear to couple the spring 79 to the cam assembly 59. The cam profile 103 has a charging portion 103*c* and an energy release portion 103R. The cam charging portion 103*c* increases in radius as the cam assembly is rotated counterclockwise, in a manner to be described, as shown in FIGS. 3A–3D. Thus, as the cam assembly rotates from the uncharged position shown in FIG. 3A, to the charged position shown in FIG. 3B, the increasing radius of the profile 103*c* results in compression of the springs 79. At the end of the charging portion 103*c* of the cam profile, the radius of the cam reaches a maximum at about 170 degrees of rotation from the uncharged position of FIG. 3A and then begins to decrease in magnitude. Throughout the energy release portion 103*c* of the cam profile 103, the radius of the spring cam continues to decrease. This decrease in the radius of the spring cam with rotation in the counterclockwise direction results in the spring driving the cam assembly.

The operating mechanism 45 closes the separable contacts 13 by engagement of cam lobes 105 on the drive cams 71 with the moveable contact assembly. These cam lobes 105 engage a cam follower 107 on the moving contact assembly 25. The cam follower 107 includes a bracket 109 with legs which straddle the contact arm 27 and rollers 111 mounted on the bracket which engage the cam lobes 105. One of the difficulties in incorporating a spring-powered operating mechanism in a molded case circuit breaker is the limited space available. This limited space dictates that the cam follower 107 be positioned relative to the cam assembly 59 such that as the cam lobe 105 initially engages the cam follower 107, the cam follower moves through an arc which brings it closer to the drive cam 71. This precludes having a cam lobe 105 which gradually increases in radius because the tendency for the cam follower to move closer to the drive cam initially would cause the mechanism to jam. Therefore, the cam lobes 105 have a leading edge 113 which accommodates for the initial movement of the cam followers toward the drive cam. Preferably, this leading edge is radial relative to the cam shaft 69. If this leading edge 113 of the cam lobe 105 is raked forward, the mechanism will bind. If it is raked rearward too much, it will hook the follower and jam. Thus, this leading edge 113 can be raked rearward to some extent, but preferably it is radial to the cam shaft 69.

The separable contacts 13 are opened by continuing the counterclockwise rotation of the cam assembly. The cam lobes 105 have a trailing edge 115 which forms a notch or recess 117 into which the cam follower 107 drops allowing the opening spring 65 to rapidly rotate the contact arm to the open position.

The cam assembly 59 is latched in a charged position and a closed position by a latch mechanism 119 which forms part of the operating mechanism 45. The latch mechanism includes a latch 121 in the form of a D-shaft 123 also journalled in the side plate 67. This D-shaft 123 has a notch 125 extending transversely through the shaft. A torsion spring 127 biases the D-shaft 123 to a latched position. A release lever 129 from extending transversely from the D-shaft 123 is engaged by an extension 131 on a push-button 133 to rotate the D-shaft to an unlatched position.

The latch mechanism 119 also includes a Y-shaped latch member 135 mounted on a shaft 137 journalled between the side plates 67. This Y-latch member 135 has a first leg 139 which is biased against the D-shaft 123 by a torsion spring 141. A second leg 143 of the Y-latch member 135 successively engages the stops 75 and 77 to latch the cam assembly in the spring fully charged and partially charged positions as will be described. The third leg 145 serves as a reset lever which is engaged by the stops 75 and 77 to reset the latch mechanism, also as will be described.

Figure 4:
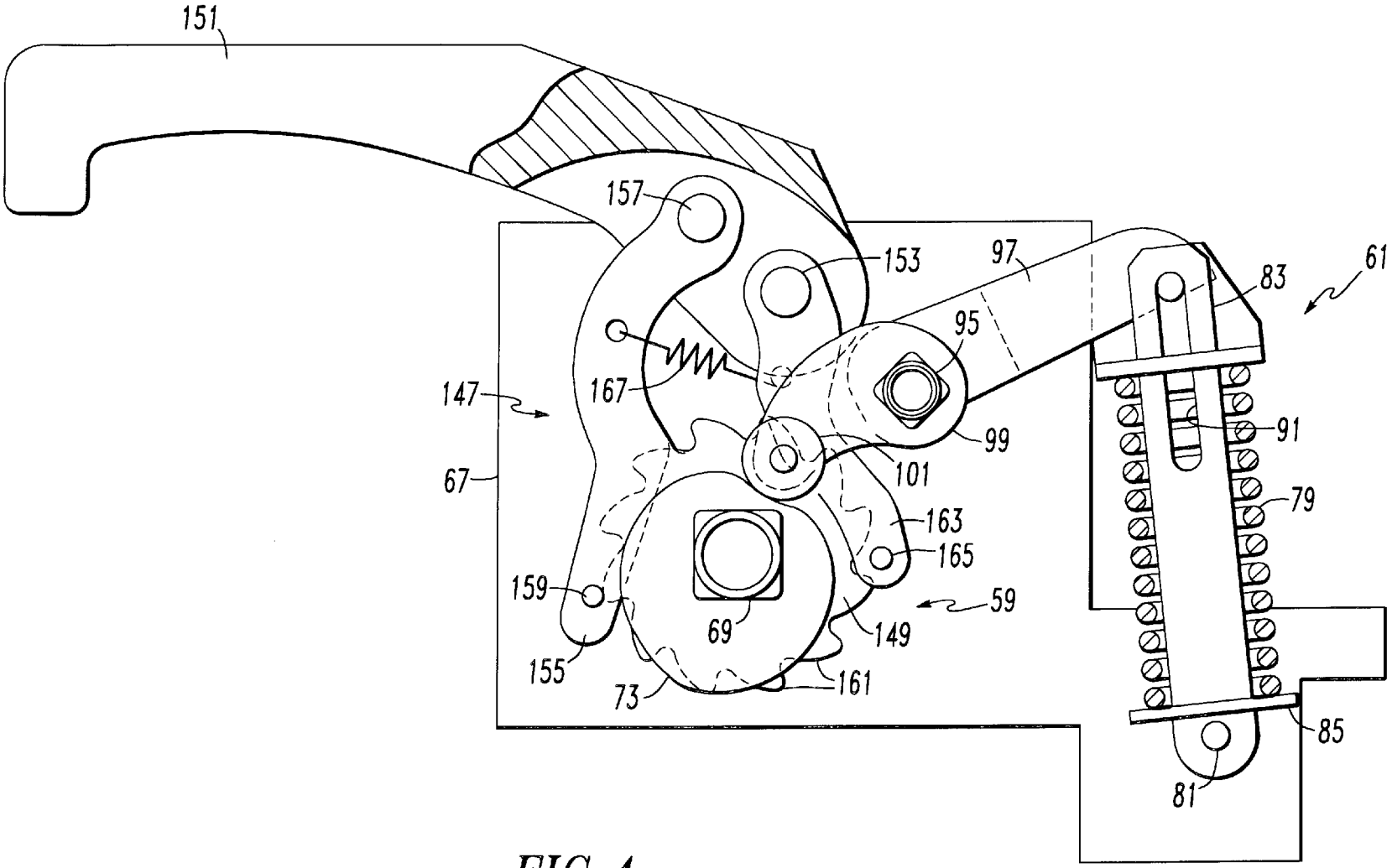
FIG. 4 is an end elevation view of the operating mechanism.
Figure 5:
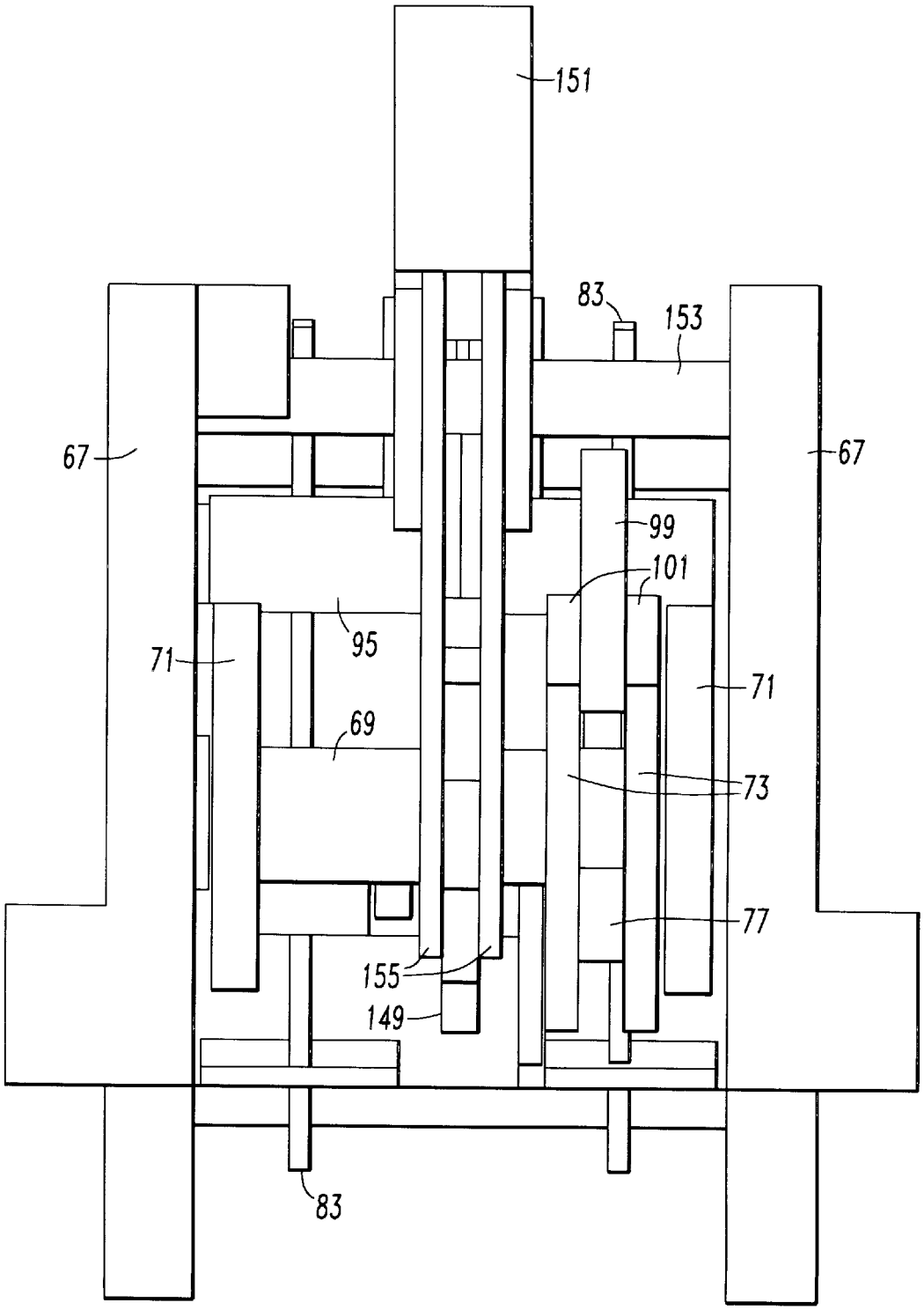
FIG. 5 is an elevation sectional view showing the charging mechanism in accordance with the invention.

The operating mechanism 45 also includes a spring charging mechanism 147 for charging the energy storage springs 79. As best viewed in FIG. 4, this manual charging mechanism 147 includes a ratchet wheel 149 keyed on the cam shaft 69 by the square configuration of the shaft and the opening in the ratchet wheel. An elongated handle 151 is pivotally mounted on a shaft 153 journalled in the side plate 67. A pair of drive links 155 are pivotally connected to the handle by a pin 157. A drive pin 159 extending between the free ends of the drive links 155 which straddle the ratchet wheel 149 engages teeth 161 on the ratchet wheel. A pair of stop links 163 are pivotally mounted on the handle shaft 153 and also straddle the ratchet wheel 149. A pin 165 extending between the stop links 163 forms a stop pawl which engages the ratchet teeth 161. A tension spring 167 biases the drive links and the stop links against opposite sides of the ratchet wheel 149. As the handle 151 is pulled away from the molded casing 3, the drive pin engages a tooth 161 on the ratchet wheel and incrementally rotates the cam assembly. As the handle is returned toward the casing 3 upon the completion of the stroke, the stop pawl 165 engages a tooth on the ratchet wheel to prevent the ratchet wheel from reverse rotation. Thus, by repeated strokes of the handle 151, the energy storage springs 79 are charged.

The operation of the circuit breaker 1 can be best understood through reference to the FIGS. 3A through 3D. FIG. 3A illustrates the circuit breaker with the separable contacts 13 open and the energy storage springs 79 uncharged. Thus, the contact arm 27 is shown in the open position. It can also be seen that in this position the latch mechanism 19 is latched with the first leg 139 of the Y-latch member 135 engaging the D-shaft 123. It can also be seen that under these conditions the cam assembly 59 is rotationally positioned so that the cam lobes 105 on the drive cam are positioned away from the cam follower 107 on the moving contact assembly 25. It can be further seen that the rollers 101 on the follower link 63 engage the spring cams 73 at the minimum radius point of the charging portion 103*c* on the cam profile of the spring cams 73. Through reciprocal operation of the handle 151, the cam assembly is incrementally rotated counterclockwise as viewed in FIG. 3A. As the spring cams 73 rotate, the radius of the charging portion 103 of the cam profile increases so that the follower link 63 rotates counterclockwise to compress the energy storage springs 79. As mentioned, as the springs 79 become fully charged, the radius of the charging portion 103C of the spring cam profile in contact with the rollers 101, begins to decrease so that the assembly begins to act like a motor as the springs exert a force through the follower link 63 tending to drive the cam assembly 59 in the counterclockwise direction as shown in FIG. 3B. However, this continued counterclockwise rotation of the cam assembly is blocked by engagement of the second leg 143 of the Y-latch member 135 which engages the stop 75. Thus, as shown in FIG. 3B, the energy storage springs 79 are fully charged and the contact arm 27 remains in the open position.

In order to close the separable contacts 13, the push button 133 is depressed. This rotates the D-shaft 123 counterclockwise causing the first leg 139 of the Y-latch member 135 to pass through the notch 125 under the bias of the spring 141 thereby lifting the second leg 143 out of engagement with the stop 75. With the rollers 101 now bearing against the energy release portion 103R of the cam profile on the spring cams 73, the energy storage springs 79 rapidly rotate the cam assembly 59 counterclockwise. As the lobes 105 on the drive cams 71 approach the cam follower 107, the rollers 111 engage the leading edge 113 of these lobes and roll inwardly along this leading edge initially as the lobes continue to rotate and rotate the contact arm assembly 25 clockwise toward the closed position. With continued rotation of the cam assembly 59, the rollers 111 roll up onto the peripheral edge of the cam lobes 105 to drive the moving contact assembly 25 to the fully closed position as shown in FIG. 3C. As the cam assembly 59 rotates from the position shown in FIG. 3B to that shown in FIG. 3C, the second leg 143 of the Y-latch member 135 is engaged by the stop 75 which rotates the Y-latch member clockwise back to the latched position for engagement with the D-shaft 123 which is also returned to the latched condition by the torsion spring 127. As the cam assembly 59 reaches the rotational position shown in FIG. 3C, further rotation is prevented by engagement of the second leg 143 of the Y-latch member 135 with the second stop 77. Thus, the mechanism is latched in the closed position. It will be seen that the energy storage springs 79 remain partially charged at this point. It can also be appreciated that at this point the opening spring 65 has been charged by the closing of the open contact assembly 25.

Depressing of the push button 133 a second time results in unlatching of the latching mechanism 119 in the manner similar to that described above so that the energy storage spring 79 continues to rotate the cam assembly 59 in the counterclockwise direction back to the position as shown in FIG. 3A. When the rollers 111 on the cam follower 107 reach the end of the cam lobes 105, they pass into the recess 117. Upon disengagement of the cam follower from the cam lobes 105, the opening spring 65 rotates the moving contact assembly 25 to the open position as shown in FIG. 3A. Thus, it can be seen that depressing the push button 133 a first time results in closing of the separable contacts 13 and depressing it a second time opens the contacts.

Figure 3D:
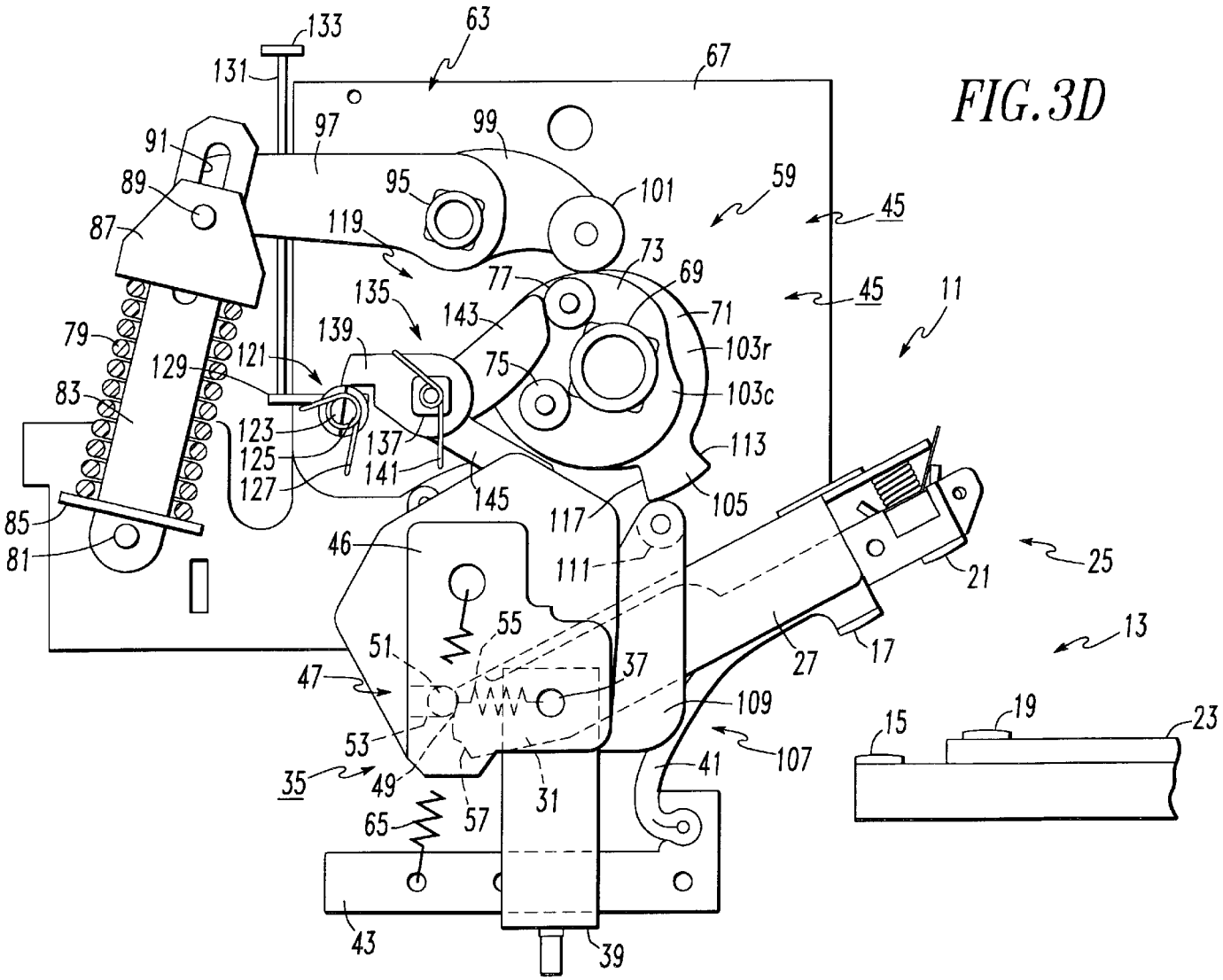
FIG. 3D is a view similar to FIG. 3A shown with the contact arm blown open and with the spring partially charged.

Should a short circuit occur while the circuit breaker is in the closed position shown in FIG. 3C, the magnetic repulsion forces produced by such a high current exert an opening force on the contact arm 27. This force overcomes the force exerted by the coupling pin 51 so that the contact arm rotates to the open position while the contact carrier 35 remains in the closed position as shown in FIG. 3D. This occurs very rapidly before the trip mechanism of the circuit breaker has responded to the overcurrent condition. However, when the trip mechanism generates a trip signal, the latch mechanism is unlatched so that the energy storage springs 79 rotate the cam assembly 59 to the position shown in FIG. 3A. This allows the opening spring 65 to rotate the contact arm carrier 35 to the open position of FIG. 3A. As this occurs, the blow open coupling 47 reengages the contact arm.

The invention makes possible a molded case circuit breaker with a higher current rating than is currently available by providing energy storage springs for closing the separable contacts of the breaker. The same energy storage springs are also utilized to initiate opening of the circuit breaker, although the actual rotation of the moving contact assembly to the open position is accomplished by an opening spring. The operating mechanism incorporating the energy storage springs is compact enough that it can be inserted into existing molded case circuit breaker housings. Furthermore, the operating mechanism is designed for low cost and ease of manufacture. All of the components are mounted on shafts captured between the two side plates and separate fasteners are not required. This arrangement also fixes the positions of the parts thereby eliminating the need for adjustments.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An electric power switch comprising:

a molded casing;

at least one pole mounted in said molded casing and comprising:

a set of separable contacts including a stationary contact and a moveable contact; and a moving contact assembly on which said moveable contact is mounted and moveable between a closed position in which said separable contacts are closed and an open position in which said separable contacts are open;

an operating mechanism mounted in said molded casing and comprising:

a cam assembly including a cam shaft and a drive cam mounted on said cam shaft;

an energy storage spring; and coupling means coupling said energy storage spring to said cam assembly to rotate said cam shaft and with it said drive cam, said drive cam having a cam lobe configured to engage and move said moving contact assembly to said closed position closing said separable contacts as said cam assembly is rotated by said energy storage spring to a closed position, and configured to release said moving contact assembly through further rotation of said cam assembly including said drive cam by said energy storage spring to an open position; and an opening spring biasing said moving contact assembly to said open position.

2. The electric power switch of claim 1 wherein said moving contact assembly includes a drive cam follower which is engaged by said cam lobe and which pivots about a fixed pivot, said cam shaft being positioned relative to said fixed pivot so that said cam follower rotates in an arc which initially brings said cam follower closer to said cam shaft as said drive cam follower is engaged by said cam lobe, said cam lobe having a leading edge configured to allow said cam follower to move toward said cam shaft initially as said cam lobe engages said cam follower through rotation of said drive cam.

3. The electric power switch of claim 2 wherein said leading edge of said cam lobe is configured to be generally radial to said cam shaft.

4. The electric power switch of claim 3 wherein said drive cam lobe has a trailing edge forming a recess which provides clearance for said cam follower allowing said opening spring to open said separable contacts as said drive cam is rotated past said closed position.

5. The electric power switch of claim 1 wherein said moving contact assembly comprises a contact arm having a first free end on which said moveable contact is mounted and a second end, and means mounting the second end of said contact arm for rotation of said contact arm about said fixed pivot.

6. The electric power switch of claim 5 wherein said means mounting said contact arm comprises a contact arm carrier pivotally mounted for rotation about said fixed pivot and said moving contact assembly further comprises a drive cam follower projecting from said contact arm carrier and which is engaged by said drive cam, said contact arm being releasably pivotally mounted on the contact arm carrier for blow open relative to said contact arm carrier in response to magnetic repulsion forces generated by short circuit current through said set of separable contacts.

7. The electric power switch of claim 6 in which said cam shaft is positioned relative to said fixed pivot so that said drive cam follower rotates in an arc which initially brings said drive cam follower closer to said cam shaft as said drive cam follower is engaged by said cam lobe, said cam lobe having a leading edge which extends generally radially to said cam shaft.

8. The electric power switch of claim 1 wherein said cam assembly includes a spring cam fixed on said cam shaft, said coupling means comprises a link engaging said energy storage spring and said spring cam, and said operating mechanism includes spring charging means coupled to said cam shaft, said spring cam having a cam profile with a charging portion over which said spring stores energy with rotation of said spring cam by said charging means, and an energy release portion over which said spring releases energy to rotate said spring cam and with it said drive cam, said operating mechanism further including a latch mechanism latching said cam assembly in said charged position with said spring fully charged, and also latching said cam assembly including said drive cam in said closed position in which said separable contacts are closed.

9. The electric power switch of claim 8 wherein said latch mechanism comprises a latch which is actuated a first time to close said separable contacts and is actuated a second time to open said separable contacts, and a latch member having a first leg which is engaged by said latch to latch said latch member and is released by said Y-latch to unlatch said latch member, a second leg which engages a first stop on said cam assembly to retain said cam assembly in the charged position until said latch is released said first time, and which engages a second stop on the cam assembly to retain said cam assembly in the closed position until said latch is released said second time, and a third leg which is engaged by said cam assembly to relatch said latch member following release of said latch said first and second times.

10. The electric power switch of claim 9 wherein said latch member is pivotally mounted and has a spring biasing said latch member to an unlatched position, said third leg being engaged by said first stop on said cam assembly to relatch said latch member as said cam assembly rotates toward said closed position following release of said latch said first time, and said third leg being engaged by said second stop on said cam assembly to relatch said latch member as said cam assembly rotates past said closed position following release of said latch said second time.

11. The electric power switch of claim 10 wherein said first stop and said second stop are both mounted on said drive cam.

12. The electric power switch of claim 8 wherein said spring charging means includes a rachet wheel mounted on said cam shaft and a handle mechanism for engaging said rachet wheel to incrementally rotate said cam shaft to charge said energy storage spring.

13. The electric power switch of claim 12 wherein said operating mechanism includes a pair of side plates mounted within said molded casing, and wherein said cam assembly, said energy storage spring, said coupling means, said latch mechanism, said rachet wheel, and said handle mechanism are all mounted between and supported by said side plates.

14. The electric power switch of claim 8 wherein said spring charging means includes a rachet wheel and means for incrementally rotating said rachet wheel to charge said energy storage spring, and wherein said operating mechanism includes a pair of slide plates, and said cam assembly, said energy storage spring, said coupling means, said latch mechanism and said rachet wheel are all mounted between and supported by said side plates.

15. The electric power switch of claim 1 having multiple poles each having a set of separable contacts and a moving contact assembly, and including a cross-bar connecting said moving contact assemblies of said multiple poles together for simultaneous movement, said operating mechanism engaging and moving said moving contact assembly of one of said poles, the moving contact assemblies of the other poles being moved by said cross-bar.

* * * * *